US005491403A

United States Patent [19]

Lin

[11] Patent Number: 5,491,403

[45] Date of Patent: Feb. 13, 1996

[54] ALTERNATIVE VOLTAGE STABILIZER FOR IMPROVING TRANSIENT RESPONSE AND INCREASING AREA OF VOLTAGE STABILIZED

[76] Inventor: Hui-Chi Lin, No. 2, Alley 2, Lane 637, Jong Jeng Rd., Jong Her City, Taipei Hsien, Taiwan

[21] Appl. No.: 413,791

[22] Filed: Mar. 30, 1995

[51] Int. Cl.[6] ..... G05F 1/40

[52] U.S. Cl. ..... 323/282

[58] Field of Search ..... 323/282, 284; 363/39, 50; 361/90, 91, 92, 111

[56] References Cited

U.S. PATENT DOCUMENTS

| | | | |
|---|---|---|---|
| 4,539,617 | 9/1985 | Delaney et al. | 361/58 |
| 5,095,261 | 3/1992 | Schoofs | 323/222 |
| 5,111,373 | 5/1992 | Higaki | 363/37 |
| 5,162,963 | 11/1992 | Washburn et al. | 361/18 |
| 5,315,497 | 5/1994 | Severinsky | 363/34 |
| 5,386,187 | 1/1995 | Bichler et al. | 323/227 |

*Primary Examiner*—Peter S. Wong
*Assistant Examiner*—Adolf Berhane
*Attorney, Agent, or Firm*—Pro-Techtor International

[57] ABSTRACT

Alternative voltage stabilizer for improving transient response and increasing area of stabilized voltage composed of a low pass input filter circuit, a wave dividing circuit, a voltage reducing and width modulating circuit, a voltage supplementing and width modulating circuit, a wave recombining circuit and a low pass output filter circuit, it divides the supply voltage into positive and negative half cycles, supplements or reduces the waves by on-off transistors, capacitors and inductors therein, and recombines and recovers them to be rated stable voltage outputs, has the advantage of low dynamic output impedance, fast response, good stabilizing ratio and transient response, and broader areas of stabilized voltage, suits the case which activates frequently or severely reqires for stable voltage.

5 Claims, 7 Drawing Sheets

| | | Q1 | Q2 | Q3 | Q4 | L1 | L2 |
|---|---|---|---|---|---|---|---|
| reducing voltage | positive half cycle | reverse PWM | OFF | OFF | OFF | raising voltage and filtering wave | ------ |
| | negative half cycle | OFF | OFF | reverse PWM | OFF | ------ | raising voltage and filtering wave |
| supplementing voltage | positive half cycle | ON | PWM | OFF | OFF | filtering wave | ------ |
| | negative half cycle | OFF | OFF | ON | PWM | ------ | filtering wave |

FIG. 3

ALTERNATIVE VOLTAGE STABILIZER FOR IMPROVING TRANSIENT RESPONSE AND INCREASING AREA OF VOLTAGE STABILIZED

BACKGROUND OF THE INVENTION

1. Field of the Invention

The present invention relates to an alternative voltage stabilizer capable of improving transient response and increasing area of stabilized voltage, and especially to one which uses elements such as on-off transistors, capacitors, inductors etc. to supplement or reduce the voltage input to become a rated voltage, has the characters of low dynamic output impedance, fast response, and good stabilizing ratio of voltage and transient response, as well as broader area of voltage stabilized.

The fast development and advance of industry and commerce renders the supply of electricity power to be insufficient when in need, yet establishing of power plants is too slow to be in help due to the difficulty of land obtaining and various protestation, therefore, insufficiency of power supply often occurs during the peak hours of electricity consuming in summer time or when the consumers are the end-consumers, the supply voltage thus often appears to be unstable in high and low values intermitently. The power supply equipment can only be protected and operate regularly by a power stabilizing device to control the voltage to be at a rated value.

2. Description of the Prior Art

Conventional alternative voltage stabilizers include the following types depending on their ways of controlling:

(1) the motor driven self-coupling transformer types: they can produce stable voltages, but have the defects of large volume, heaviness, and slow responsing speed;

(2) magnetic resonance transformer types: they use the principle of resonance to stabilize voltage, however, they have the defects of high working temperature, big noise, large volume, heaviness and low overload current;

(3) silicon controlled rectifier types: they control the phase angles of power sourses, but have the defects of having notches in their output wave forms, having big harmonic distortion, and large volume as well as heaviness;

(4) saturated magnetic field indution types: they use the saturation characteristic of transformers, and also have the defects of big noise, large volume and heaviness;

(5) jumping or digital types: the output voltages of them are non-linear, and are modulated in a level jumping mode, have inferior voltage stabilizing ratio, slow response, and low reliability;

(6) phase transfer or amplifier types: composed of rectifier and filter circuits, have the defects of low input power, low efficiency, and low acuracy.

Summarily, the conventional alternative voltage stabilizers include the defects as follows:

(1) inferior responsing speed and transient response: their mechanical response speed is about 10–30 cycles, while about 3–5 cycles for electronic type, and about 1.5 cycles for resonant type, the impedance of the dynamic output of such types is very high, thus render the transient response thereof to be inferior;

(2) narrow area of input voltage: the area for normal electronic type is ± 15%, for resonant type is ± 20%, their availability is therefore limited;

(3) voltage stabilizing ratio and efficiency: the voltage stabilizing ratio of most of them can be coincident with the standard of 1–3%, however, the impedances of the dynamic working current and dynamic output thereof are very high, so that their efficiency is low, and even they are not able to accept any other load outside, they appear on themselves high temperature state, thus apparently do not suffice the practical requirement.

(4) volume and weight: they generally have the defects of heaviness and large volume.

SUMMARY OF THE INVENTION

The main object of the present invention is to divide the supply votage into positive and negative half cycles, and to supplement or reduce the voltage input through the on-off transistors, capacitors and inductors and corresponding to modulation of the width of pulses, having the advantage of low dynamic impedance, better transient response, efficiency as well as better stabilizing ratio of voltage.

The senconary object of the present invention is to broaden the area of stabilized working voltage by supplement or reducing of the voltage input, so that the area of stabilized voltage can be brodened to be over ±50%, i.e., the stabilized input voltage has a broader area of value.

Another object of the present invention is to reduce the weight, the volume as well as the cost of the whole device by using light weighted on-off transistors, capacitors and inductors instead of the traditional transformers, the volume and the weight of the device can be largely reduced. Normally in an alternative voltage stabilizer, the inductors and the transformers occupy the most part of its volume, weight and cost, while an inductor used in the present invention is only about 5% by weight of a magnetic resonant type; e.g., when its output is designed to be 1 KVA, the total volume thereof is about 45 mm×45 mm×50 mm, its weight is only about 270 g.

The present invention will be apparent in re the realistic structure and the arrangement in practising thereof after reading the detailed description of the preferred embodiment thereof in reference to the accompanying drawings.

BRIEF DESCRIPTION OF THE DRAWINGS

FIG. 3 shows the operational situation of the on-off transistors and the inductance coils of the present invention;

DETAILED DESCRIPTION OF THE PREFERRED EMBODIMENT

Figure 1:
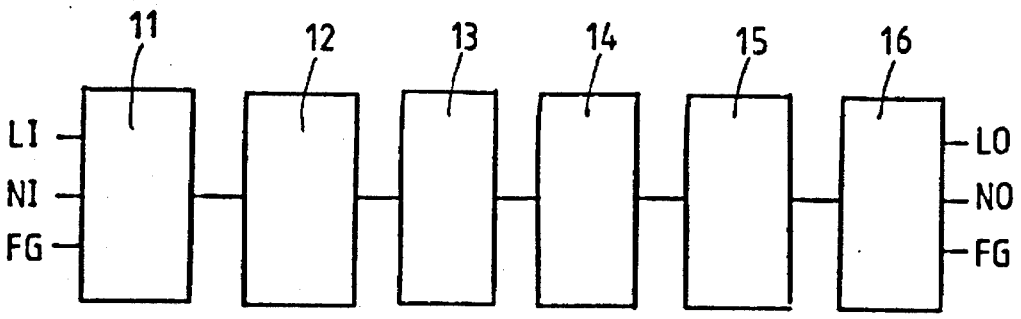
FIG. 1 is the block diagram of the present invention.
Figure 2:
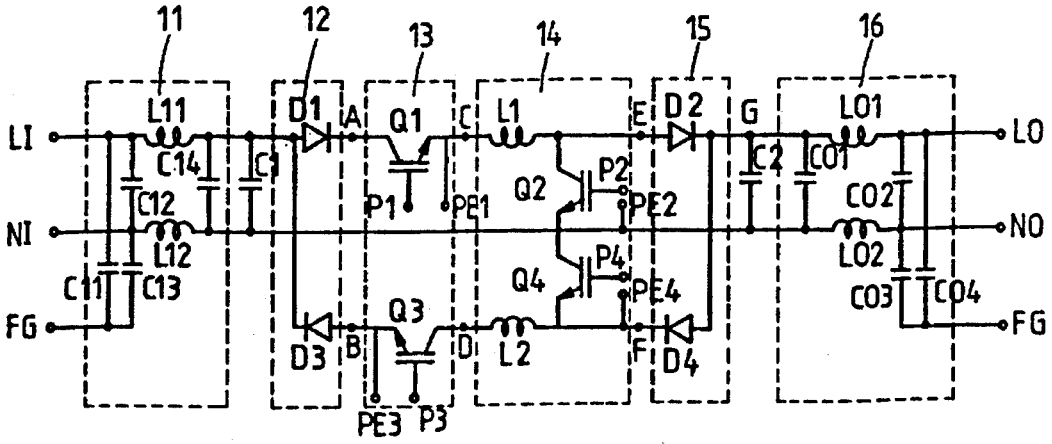
FIG. 2 is the circuit diagram of the present invention.

Referring firstly to FIG. 1 and FIG. 2, the present invention is composed of a low pass input filter circuit 11, a wave dividing circuit 12, a voltage reducing and width modulating circuit 13, a voltage supplementing and width modulating circuit 14, a wave recombining circuit 15 and a low pass output filter circuit 16, the supply voltage is input from the terminals LI, NI; wherein the low pass input filter 11 is composed of the inductors L11, L12 and the capacitors C11, C12, C13 and C14 connecting parallelly with each other, a capacitor C1 is jumper connected at the rear thereof, so as to prevent the low frequency interference; the diodes D1 and D3 are parallelly connected, so as to divide the input sinusoidal wave into positive and negative half cycles; the cathode of D1 connects the collector of Q1 of the voltage reducing and width modulating circuit 13, the anode of D3 also connects the emitter of Q3; the voltage supplementing and width modulating circuit 14 mainly connects L1 to the collector of Q2, connects L2 to the emitter of Q4, and the emitter of Q2 is connected with the collector of Q4; D2 and D4 are disposed in contrary phase state for combining the divided wave forms to recover the original wave; after that, a high frequency filtering capacitor C2 is jumper connected at the rear thereof, a low pass filter circuit 16 composed of LO1, LO2, CO1, CO2, CO3 and CO4 is connected at the rear end; the on-off transistors Q1, Q2, Q3 and Q4 are preferably insulating gate transistors, the gates thereof provide respectively with the input terminals P1, P2, P3 and P4, so that when the supply voltage is too high or too low, a modulation signal will input after comparing of the error by a comparing circuit.

Figure 4:
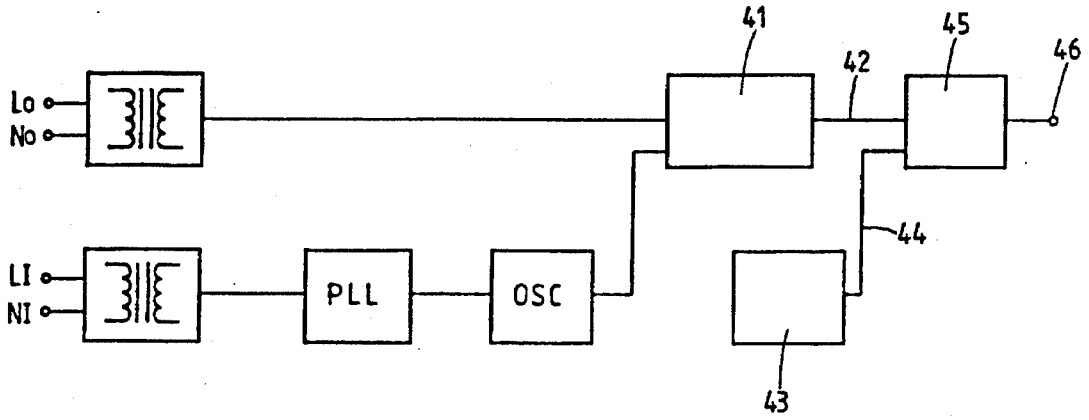
FIG. 4 is a comparing block diagram directing to the error in practising the present invention.

As to the comparing circuit, it can be seen in FIG. 4, it compares an alternative sinusoidal standard wave directly with feedback signals (LO, NO) of an alternative voltage stabilizer for the error after an alternative sinusoidal standard wave generator (OSC) oscilates to give a low distortioned alternative sinusoidal standard wave and the supply power frequency reaches synchronism and phase lock (PLL), once the feedback signals (LO, NO) has slight errors, it can obtain correcting signals 42 for the errors, the error correcting signals 42 are compared by a comparator 45 with the high frequency triangular wave signal 44 generated by a high frequency triangular wave generator 43, and then a high frequency pulse width modulating signal (PWM) changing fast in pursuance of the high and low values of the supply voltage, so that it can supplement or reduce the voltage in due time; by such a way, when the value of the supply voltage changes suddenly, several decades of pulse signals will be controlled in only 1 milli-second to supplement or reduce the voltage in due time, this can be available for continuous changing of the voltage, but we shall not describe in detail the error comparing technique for it is not the main part of the present invention.

Figure 5:
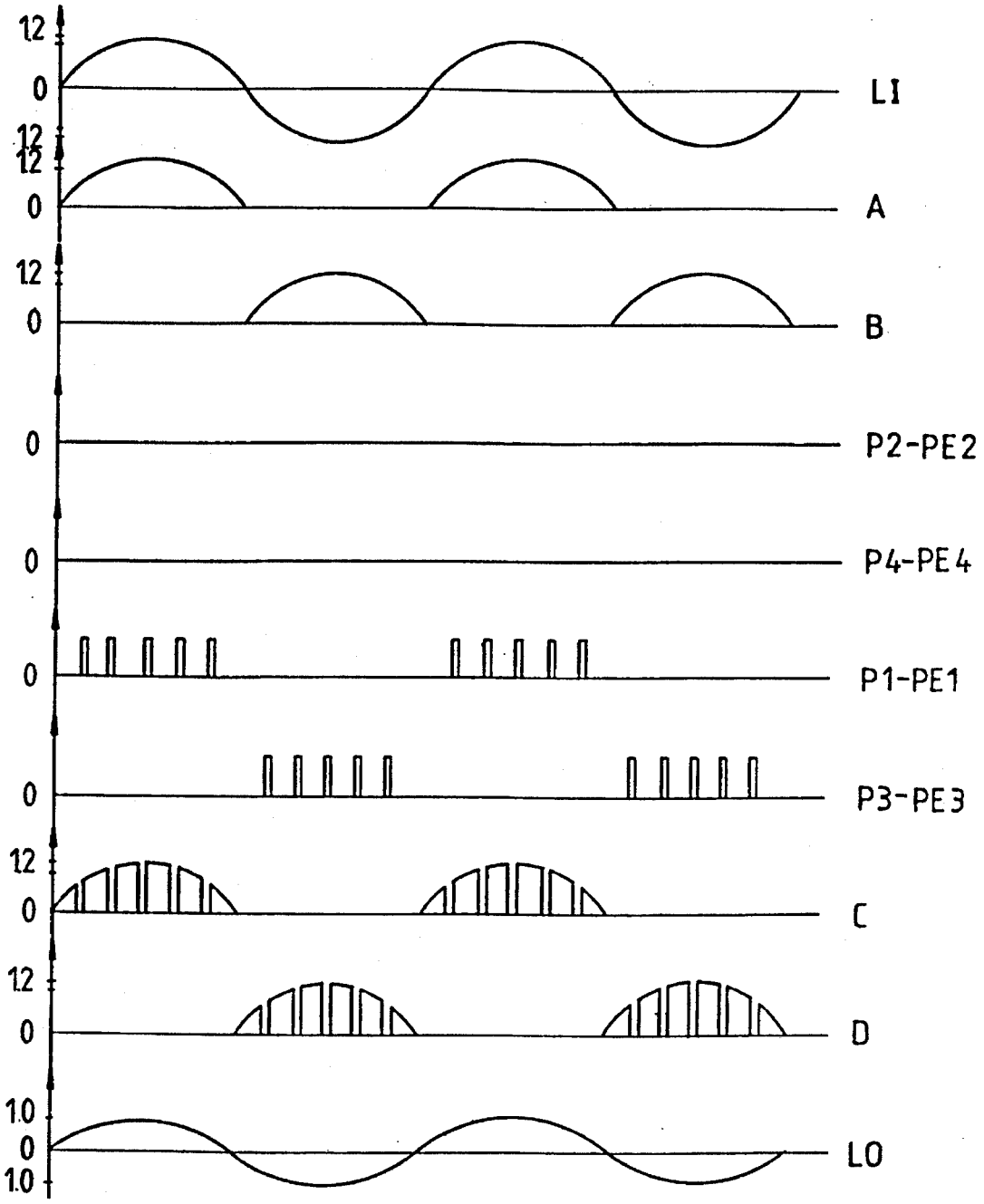
FIG. 5 shows the wave forms in reducing the voltage in the present invention.

Referring again to FIG. 3 and FIG. 5, when the supply power source (LI) is higher than the rated value, it is divided into positive half cycles A and negative half cycles B through D1 and D3, it's voltage needs to be reduced in this case, so that when the positive half cycles A run through the on-off transistor Q1, the gate P1 of Q1 will input a reverse pulse width modulating signal (P1-PE1, and in FIG. 3, it is marked as "reverse PWM"); while the negative half cycles B run through Q3, the gate P3 of Q3 will also input a reverse pulse width modulating signal (P3-PE3) to cut it with a high frequency, in this way, the positive and negative half cycles A, B produce through the voltage reducing width modulating circuit 13 modulating signals C, D for modulation,then they are filtered and charged by L1, L2 and C2 to render the output to be the desired low frequency alternative current, and then are recombined and recover ed to be a desired and rated wave voltage LO by a wave recombining circuit 15, Q2 and Q4 are off, the voltages of the gates (P2-PE2, P4-PE4) are all in low levels.

Figure 6:
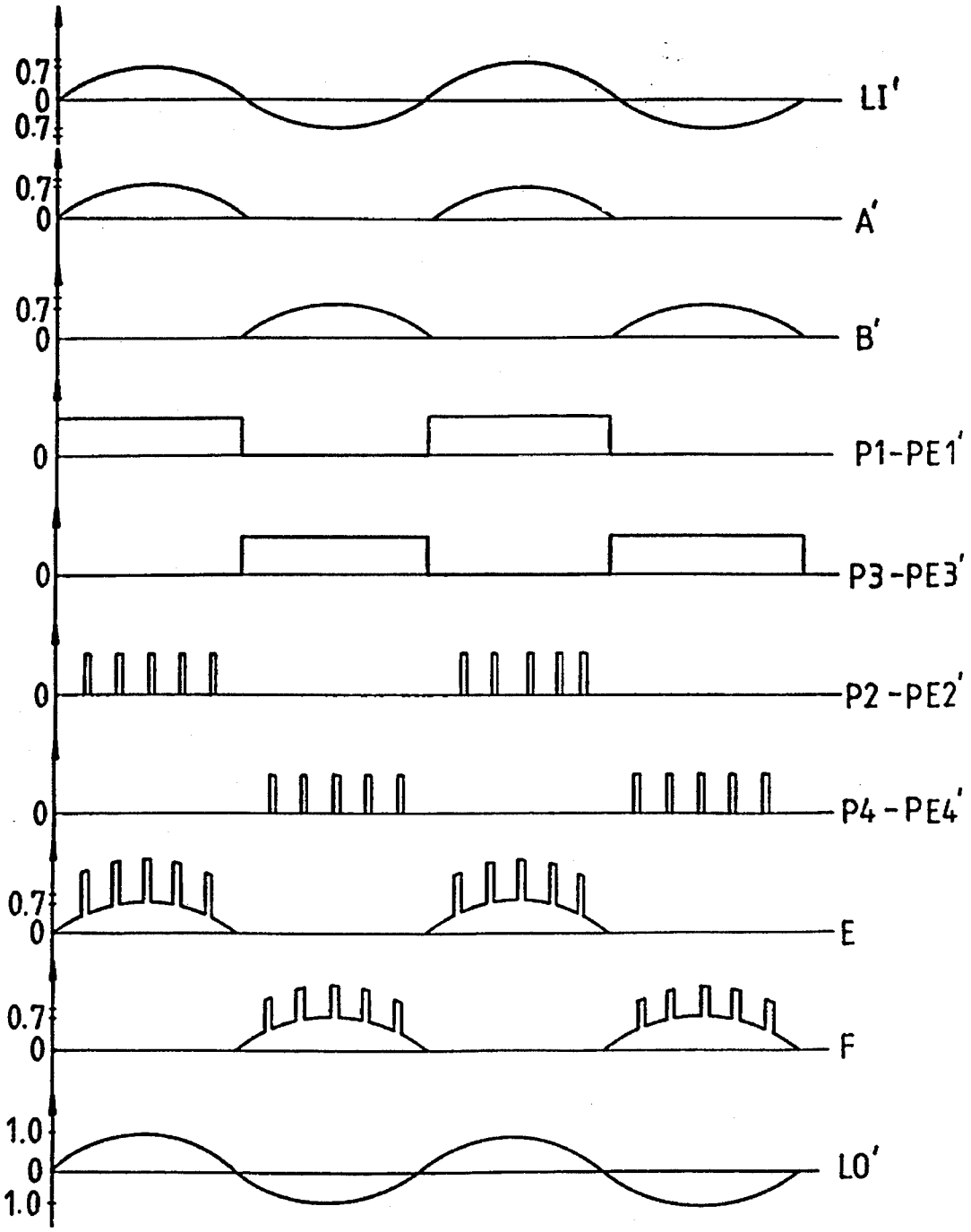
FIG. 6 shows the wave forms in supplementing the voltage in the present invention.

On the contrary, when the supply power source (LI') is lower than the rated value, it's wave form is divided into positive half cycles A' and negative half cycles B' through D1 and D3, as shown in FIG. 6, the positive half cycles A' run into two loops: one is LI-L11-D1-Q1-L1-Q2-L12-NI, the high frequency positive half cycles thereof store energy for L1; the other is LI-L11-D1-Q1-L1-D2-LO1-LO-NO-LO2-L12-NI, the high frequency positive half cycles thereof do inductive energy draining to charge C2 to render the voltage on C2 to be raised to a rated value, meantime, the gate voltages (P3-PE3', P4-PE4') on Q3 and Q4 are low, hence Q3 and Q4 are off; while the gate voltage of Q1 is in a high level (P1-PE1'), hence Q1 is on; the gate voltage of Q2 will input a pulse width modulating signal (P2-PE2').

The negative half cycles B' also run into two loops: one is LI-L11-D3-Q3-L2-Q4-L12-NI, the high frequency negative half cycles thereof store energy for L2, the amount of energy being stored depends on the error of the supply voltage compared with the output voltage of the voltage stabilizer, the larger the error, the more the voltage supplement is needed, so that the wider the width of the pulse, the larger the amount of energy is to be stored; the other loop is LI-L11-D3-Q3-L2-D4-LO1-LO-NO-LO2-L12-NI, the stored energy in L2 is also drained to C2 to render the voltage of the negative half cycles to be raised to a rated value, meantime, Q1 and Q2 are off, the input gate voltage is low, while the gate P3 of Q3 is in a high voltage level (P3-PE3'), hence Q3 is on, the gate P4 of Q4 will input a pulse width modulating signal (P4-PE4'), the voltage wave forms of the positive and the negative half cycles being pulse width modulated are shown respectively by E and F (these are the wave forms in the absence of C2), and lastly are recombined by the wave recombining circuit 15 and are recovered to be a desired and rated wave voltage LO', thus the supplement is completed.

Figure 7:
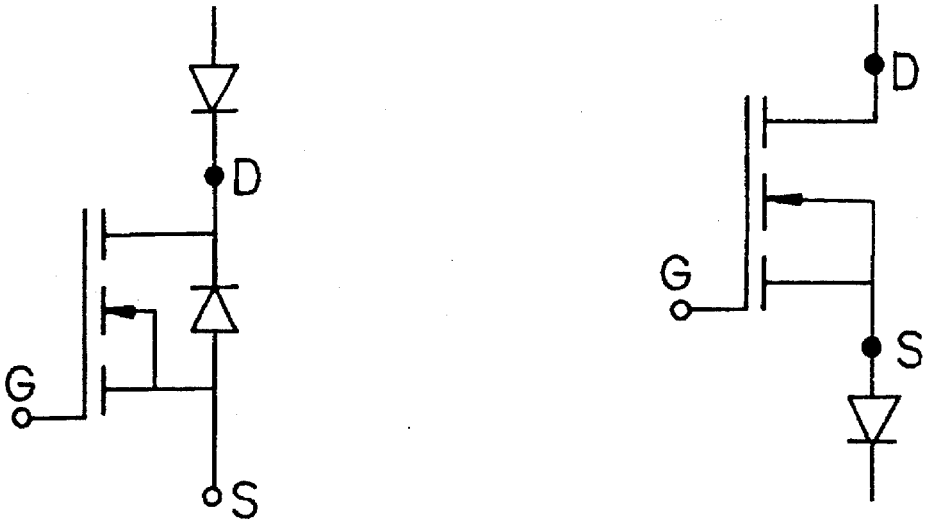
FIG. 7 shows the connecting of an outside normal direction diode to the transistors Q2, Q4 which are field effect transistors in this case.

Further, though Q1, Q2, Q3 and Q4 are insulating gate transistors as stated above, however, normal transistors or field effect transistors can be used instead thereof, but if Q2 and Q4 are substituted by the field effect transistors, the source and the drain thereof must be connected with a normal direction diode (as shown in FIG. 7).

In conclusion, the alternative voltage stabilizer for improving transient response and increasing area of stabilized voltage of the present invention divides the supply voltage into positive and negative half cycles, and then supplements or reduces the input waves by a plurality of elements such as on-off transistors there in, and recombines and recovers them to be stable and rated voltage outputs, thus completely gets rid of the defects of low response, inferior transient response, low stabilizing ratio and efficiency as well as large volume and heaviness of the conventional stabilizers using transformers etc., and has the advantage of low dynamic output impedance, fast response, good stabilizing ratio and transient response, as well as broader areas of stabilized input voltage, it is really novel and practical.

My invention may assume numerous forms and is to be construed as including all modifications and variations falling within the scope of the appended claims.

I claim:

1. An alternative voltage stabilizer capable of improving transient response and increasing area of stabilized voltage, includes:

a low pass input filter circuit: which is composed of a first and second inductors and a plurality of input capacitors, another capacitor is jumper connected at the output of the circuit, so as to prevent low frequency interference;

a wave dividing circuit: which divides input sinusoidal wave into positive and negative half cycles through two diodes parallelly connected with each other;

a voltage reducing and width modulating circuit: which is composed of two on-off transistors, the collector of the first transistor being connected to the cathode of one of said diodes, while the emitter of the other of the second transistor being connected to the anode of the other of said diodes, and the gates of said transistors being connected with outside input signals;

a voltage supplementing and width modulating circuit: a third inductor therein being connected to the collector of a third transistor, a fourth inductor is connected to the emitter of a fourth transistor, the emitter of said third transistor being connected to the collector of said fourth transistor, the gates of said another and said fourth transistor being respectively connected with outside input signals;

a wave recombining circuit: which recombines said divided wave forms and recovers them to be alternative waves by contrary phased disposing of a third and fourth diodes, the output of the wave circuit being jumper connected with a high frequency filter capacitor;

a low pass output filter: which is composed of third and fourth inductors and a plurality of output capacitors;

an error comparing circuit: which compares an alternative sinusoidal standard wave directly with feedback signals of an alternative voltage stabilizer for the error after an alternative sinusoidal standard wave generator oscillates to give a low distortioned alternative sinusoidal standard wave and supply power frequency reaches synchronism and phase lock, once said feedback signals having slight errors, it produces a correcting signals for the errors, said error correcting signals being compared by a comparator with a high frequency triangular wave signal generated by a high frequency triangular wave generator, and then a high frequency pulse width modulating signal changing fast in pursuance of a high and low values of said supply power being obtained;

said stabilizer is characterized in that:

the voltage of a alternative supply power is divided into positive and negative half cycles by a wave dividing circuit, then the error of the input voltage which is too high or too low is compared by said error comparing circuit to decide the level of voltage of said gates of all said transistors, or to input suitable high frequency pulse width modulating signals or reverse pulse width modulating signals of high frequency to supplement the overly low input voltage using said inductors and capacitors, or to reduce the overly high voltage, and lastly said divided wave forms are recombined and recovered to a rated alternative waves to render said alternative voltage stabilizer to keep in a state of stable voltage output.

2. An alternative voltage stabilizer capable of improving transient response and increasing area of stabilized voltage as stated in claim 1, wherein said two on off transistors are insulating gate transistors, and can be substituted by normal transistors or field effect transistors.

3. An alternative voltage stabilizer capable of improving transient response and increasing area of stabilized voltage as stated in claim 1, wherein said another and said fourth transistors can be insulating gate transistors, and are substituted by normal transistors or field effect transistors, if substituted by said field effect transistors, the source and the drain thereof must be connected with a normal direction diode.

4. An alternative voltage stabilizer capable of improving transient response and increasing area of stabilized voltage as stated in claim 1, wherein said voltage of said alternative supply power is divided into positive and negative half cycles, then said positive and negative half cycles are stabilized separately.

5. An alternative voltage stabilizer capable of improving transient response and increasing area of stabilized voltage as stated in claim 1, wherein said first and second inductors provide filtering and voltage raising functions.

* * * * *